US005461873A

United States Patent [19]

Longsworth

[11] Patent Number: 5,461,873

[45] Date of Patent: Oct. 31, 1995

[54] MEANS AND APPARATUS FOR CONVECTIVELY COOLING A SUPERCONDUCTING MAGNET

[75] Inventor: Ralph C. Longsworth, Allentown, Pa.

[73] Assignee: APD Cryogenics Inc., Allentown, Pa.

[21] Appl. No.: 126,068

[22] Filed: Sep. 23, 1993

[51] Int. Cl.[6] ..... F25B 19/00

[52] U.S. Cl. ..... 62/51.1; 62/434; 505/892

[58] Field of Search ..... 62/51.1, 434; 505/892

[56] References Cited

U.S. PATENT DOCUMENTS 4,578,962 4/1986 Dustmann ..... 62/515

OTHER PUBLICATIONS

Golda, Michael et al. "Applications of Superconductivity to Very Shallow Water Mine Sweeping" *Naval Engineers Journal,* May 1992 pp. 53–64.

Green, Geoffrey et al. "Conductivly Cooling a Small Nb3Sn Coil with a Cryocooler " *7th International Cryocooler Conference,* Nov. 1992.

Stevenson, R. "50G. KG Gas Cooled Superconducting Solenoid Operated at 13K" *Cryogenics,* Sep. 1973, pp. 524–525.

*Primary Examiner*—Ronald C. Capossela
*Attorney, Agent, or Firm*—Helfgott & Karas

[57] ABSTRACT

Apparatus and methods for cooling a superconducting magnet by circulating a pressurized helium gas through a convective cooling loop by natural convection, and apparatus and methods have been provided for quickly and effectively cooling a warm superconducting magnet down to operating temperature.

34 Claims, 6 Drawing Sheets

MEANS AND APPARATUS FOR CONVECTIVELY COOLING A SUPERCONDUCTING MAGNET

FIELD OF THE INVENTION

This invention relates to the field of cooling a device such as a superconducting magnet. More particularly, the invention relates to an apparatus and methods for cooling a superconducting magnet with a pressurized helium gas circulated through a light weight heat transfer system by natural convection to maintain a more uniform temperature in the superconducting magnet.

BACKGROUND OF THE INVENTION

The use of Niobium Tin ($Nb_3Sn$) wire in a superconducting magnet enables cooling of the magnet by means of a conventional Gifford-McMahon cycle refrigerator, which can efficiently produce refrigeration at a temperature of between about eight Kelvin (K.) to ten K. but is capable of cooling to lower temperature. It has been demonstrated that a superconducting magnet can be cooled by conductively transferring heat generated by the magnet through an aluminum shell to a Gifford-McMahon cycle refrigerator.

In a paper entitled "Applications of Superconductivity to Very Shallow Water Mine Sweeping" by E. Michael Golda, et al., published in the Naval Engineers Journal, May, 1992, a liquid helium cooled Niobium Titanium (NbTi) magnet operating at 4.2 K. is described and compared with a conductively cooled, $Nb_3Sn$ magnet operating at 10 K. The cooling of the $Nb_3Sn$ magnet is provided by a two stage, Gifford-McMahon, closed cycle refrigerator adapted for a mine sweeping application. While the weight of the conductively cooled, $Nb_3Sn$ magnet and its insulation is less than the weight of the liquid helium cooled, NbTi magnet itself, the complete cooling system required for the conductively cooled, $Nb_3Sn$ magnet still weighs more than the liquid helium cooled, NbTi magnet because of the added refrigerator. The refrigerator, however, frees the system from the logistical problem of periodically supplying liquid helium, often under difficult circumstances. Although the Golda, et al. paper is directed to usage in combat situations, the advantages of using a conductively cooled superconducting magnet also apply to other applications, such as in hospitals.

A paper by Geoffrey F. Green, et al. entitled "Conductively Cooling a Small $Nb_3Sn$ Coil With a Cryocooler", presented at the 7th International Cryocooler Conference, Nov. 17–19, 1992, describes the construction and testing of a conductively cooled, $Nb_3Sn$ magnet. The magnet wire is wrapped around an aluminum shell which is cooled by a two stage, Gifford-McMahon refrigerator. Heat is transferred into the aluminum shell from the support structure and the cold heat shield. The heat transfer through the aluminum results in a temperature difference between the warmest position on the magnet and the refrigerator of about 2 K. This temperature difference could be reduced by constructing the shell of the magnet from thicker and heavier aluminum material.

Another reference paper by Richard Stevenson entitled "50 kG Gas Cooled Superconducting", September, 1973, p. 524, describes a $Nb_3Sn$ magnet operating at 13 K. which is cooled by a forced flow of helium gas through the windings. This is a more complex system than a conductively cooled magnet.

While conductive cooling has been demonstrated with a relatively small magnet where the wire is wrapped about an aluminum shell, as discussed above, it has not proven to be effective for a superconducting magnet constructed with a large coil wrapped about aluminum shell because of the difficulty in designing a suitable light weight shell.

OBJECTS AND SUMMARY OF THE INVENTION

It is the object of the present invention to provide a system and method for cooling a superconducting magnet by circulating pressurized helium gas through a cooling loop which is in heat transfer relationship with the magnet to obviate the problems and limitations of the prior art systems.

It is a further object of the present invention to provide a system and method of operating the system for cooling a superconducting magnet having at least two modes of operation.

It is still a further object of the present invention to provide a system and method of operating the system for cooling a superconducting magnet by circulating pressurized helium gas through a cooling loop by natural convection.

It is yet another object of the present invention to provide a system and method for cooling a superconducting magnet with helium gas which is circulated through a lightweight cooling loop by natural convection so that the magnet is held at a uniform temperature.

In accordance with the invention, there is provided a system for convectively cooling a superconducting magnet with helium gas preferentially having a pressure of about 1 Mega Pascals (MPa) to about 3 MPa. The means for convective cooling comprises cooling loop means for circulating the helium gas by natural convection through the means for supporting the superconducting magnet whereby heat is removed from the superconducting magnet and the superconducting magnet is maintained at a substantially uniform temperature of less than about 15 K.

According to the invention, the cooling loop means includes refrigerator means for cooling the helium gas. The cooling loop means also includes a down comer tube below the refrigerator means for directing the helium gas, subsequent to being cooled by the refrigerator means, to a lower header tube at a location below the superconducting magnet. Further, parallel, spaced, riser tubes connect the lower header tube to an upper header tube at a location above the superconducting magnet. The riser tubes are in thermal contact with the superconducting magnet. The upper header tube directs the helium gas, subsequent to being in thermal contact with the superconducting magnet, through the refrigeration means and into the down comer tube.

Further, in accordance with the invention, the refrigerator means include a refrigerator and a cold heat station. The cold heat station has an upper end abutted against the refrigerator and connected to the upper header tube and a lower end connected with the down comer tube. The cold heat station includes a plurality of flow channels for cooling the helium gas flowing from the upper header tube, through the flow channels, and into the down comer tube.

According to the invention, the system can include a by-pass header to direct a liquid cryogen into the cooling loop means for initially removing heat from the superconducting magnet to thereby lower the temperature of the superconducting magnet to its operating temperature. The cooling tubes may be arranged so that they carry some of the loop stresses generated by the magnet thereby reducing the weight of the conventional structure.

In accordance with the invention, a method of cooling a superconducting magnet comprises convectively cooling the superconducting magnet with the helium gas at an elevated pressure of about 1 MPa to about 3 MPa. The step of convectively cooling includes the step of circulating the helium gas through a cooling loop by natural convection to remove heat from the superconducting magnet whereby the superconducting magnet is maintained at a substantially uniform temperature of less than about 15 K. The step of circulating the helium gas through the cooling loop includes the following steps. The helium gas flows down through a cold heat station having an upper end abutted against a refrigerator and a lower end connected with a down comer tube. Then, the helium gas flows through the down comer tube and into a lower header tube. Next, the helium gas flows from the lower header tube into a plurality of riser tubes in close thermal contact with the superconducting magnet where the helium gas is heated by absorbing heat from the superconducting magnet which causes the helium gas to rise by virtue of being at a lower density than the helium gas in the down comer tube. Further, the helium circulates from the riser tubes into an upper header tube and back through the cold heat station.

According to the invention, a method for cooling a superconducting magnet comprises the following steps. First, the temperature of the superconducting magnet is lowered during a first mode of operation by circulating a liquid cryogen, such as liquid nitrogen, then liquid helium, through the cooling loop to remove heat from the superconducting magnet until the temperature of the magnet is lowered to its operating temperature less than about 15 K. Then, the delivery of liquid helium is stopped and the cooling circuit is pressurized to 1 to 3 MPa with gaseous helium. The refrigerator is then turned on and the magnet is cooled to 8 to 10 K. by the convective circulation of helium gas.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 2:
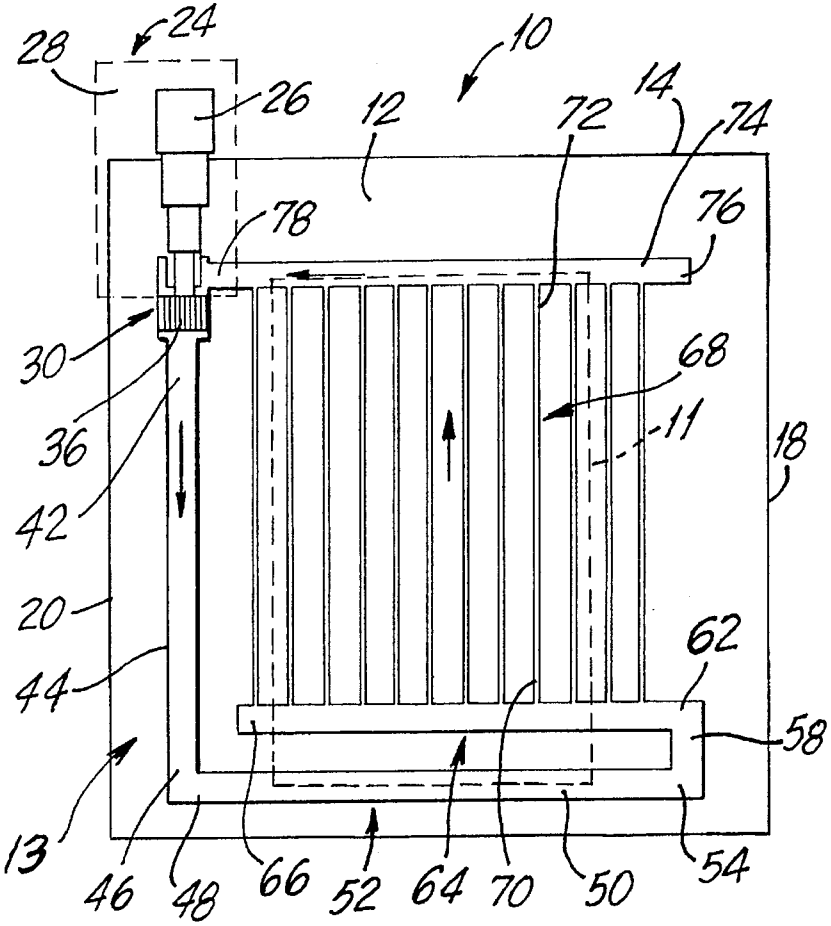
FIG. 2 is a schematic side view of the superconducting magnet structure with a convective cooling loop, as shown in FIG. 1.
Figure 1:
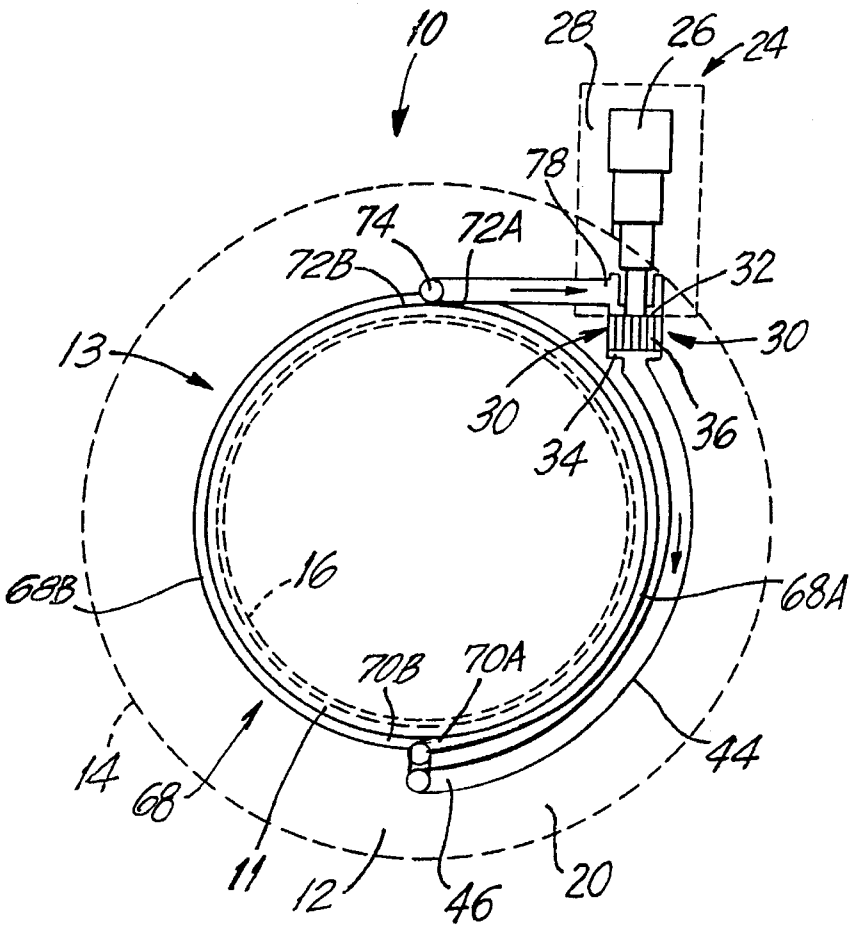
FIG. 1 is a schematic end view of a first embodiment of a superconducting magnet structure with the convective cooling loop, in accordance with the invention.

Referring to FIGS. 1 and 2, there is shown a superconducting magnet of a system 10 with a convective cooling loop 13 for cooling a large coiled, superconducting magnet 11, in accordance with the invention. The present invention accomplishes the cooling with a unique structure and method which basically circulates pressurized helium gas through convective cooling loop 13 using only the natural convection of the cold helium gas.

The system 10 includes a hollow support housing 12 having a cylindrical, outer surface 14, a coaxial throughbore 16, and disk shaped side walls 18 and 20, each having a circular opening therethrough corresponding to the diameter of throughbore 16. Cylindrically shaped, superconducting magnet 11 includes a coil wrapped around a support structure (not explicitly shown) and disposed coaxially about throughbore 16. An exemplary superconducting magnet 11 is about 760 millimeters (mm) in diameter and has a length of about 500 mm.

A principle feature of this invention is the construction and method by which magnet 11 is cooled by the natural convection of a cold helium gas flowing through convective cooling loop 13. Convective cooling loop 13 includes a conventional, closed cycle refrigerator 24 that is positioned above magnet 11 and secured to or next to support housing 12 by any conventional means. Refrigerator 24 preferably has a capacity, i.e., refrigeration load, of about 0.4 Watts (W) at about 8 K. Th refrigerator 24 can be a Gifford-McMahon or a Stirling type refrigerator with a two or three stage expander 26. The space 28 about the upper part of the expander 26 is generally at room temperature. The downstream end of refrigerator 24 is abutted against a cold heat station 30 having inlet and outlet sections 32 and 34, respectively. Cold heat station 30 consists of a plurality of flow channels 36 that are made of a thermally conductive material such as copper, and are open at their upper and lower ends to allow helium gas to flow freely through flow channels 36 between inlet and outlet sections 32 and 34, as discussed hereinafter.

The outlet section 34 of the cold heat station 30 is connected to an upper end 42 of a down comer tube 44, another part of convective cooling loop 13. Down comer tube 44 is positioned in spaced relationship from one end of magnet 11 and extends downward from cold heat station 30 to a location below magnet 11. Further, down comer tube 44 has a radius of curvature, as shown in FIG. 1, which is substantially the same as that of magnet 11. The lower end 46 of down come tube 44 is connected to an inlet 48 of a first section 50 of a lower header tube 52, a section of convective cooling loop 13 which extends perpendicularly outward from down comer tube 44 and adjacent the bottom of magnet 11 to an outlet 54 at the opposite end thereof. Outlet 54 is connected via a second section of tube 58 of lower header tube 52 to an inlet 62 of a third section 64 of lower header tube 52. Third section 64 extends substantially parallel to first section 52 and projects back along the bottom of magnet 11 to a closed end 66 near down come tube 44.

Convective cooling loop 13 further includes a plurality of spaced, cylindrically shaped, riser tubes 68 each having two curved sections 68A and 68B which together surround and are in close thermal contact with magnet 11. As shown in FIG. 1, each of the curved sections 68A and 68B is connected at its lower end 70A and 70B, respectively, to the third section 64 of lower header tube 52 and project upward so that the upper end 72A and 72B, respectively, are connected to an upper header tube 74 having a closed first end 76 and a cylindrically shaped second end 78 which is about an output end of refrigerator 24 and in flow connection with inlet section 32 of cold heat station 20. The plurality of riser tubes 68, typically numbering between eight and twelve, are in closed thermal contact with the wire coil of magnet 11 and other locations where heat is being removed and form multiple, parallel paths for the helium gas to flow about superconducting magnet 11. An advantage of locating curved sections 68A and 68B of riser tube 68 around the outer periphery of magnet 11 is that the riser tubes provide an additional beneficial function of restraining magnet 11 which has a tendency to expand radially outward under the influence of the magnetic field. While curved sections 68A and 68B of riser tubes 68 are shown as located radially outward from magnet 11, it is also within the terms of the invention to located curved sections 68A and 68B within the inner cylindrical bore of magnet 11, if desired.

An aspect of the invention is that the enclosed support housing 12 is insulated, with means such as vacuum insulation, so that neither heat from the surroundings nor generated within housing 12 is transferred through housing 12 to down comer tube 44 or upper and lower header tubes 74 and 52.

To better understand the present invention, a discussion of the theory and method of operation for cooling superconducting magnet 11 with a convective cooling cycle and apparatus follows. To initiate the convective cooling cycle, helium gas, preferably at an elevated pressure of between about 1 MPa and 3 MPa, is cooled by thermal contact with a downstream section of refrigerator 24 as the helium gas flows in convective cooling loop 13, down through heat station 30 and into the top 42 of down comer tube 44. Down comer tube 44 depends below refrigerator 24 and is thermally isolated within enclosed support housing 12 so that the cold helium gas in down comer tube 44 is at essentially the same temperature as refrigerator 24. The cold helium gas flows downward through down comer tube 44 because of its higher density as compared with the density downstream in the portion of the cooling circuit where it is warmer, i.e., in the riser tubes 68 and in the upper header 74. The cold helium gas then flows into lower header tube 52, which is also thermally isolated, and distributed to the plurality of small diameter riser tubes 68. Continuing through convective cooling loop 13 and the convective cycle, the helium gas is heated as it flows upward through riser tubes 68 by absorbing heat from superconducting magnet 11 and other heat sources (not shown) so as to maintain superconducting magnet 11 at an operating temperature of less than about 15 K. This heat absorption causes an increase in the temperature of the helium gas and a reduction in its density. The reduction in density of the helium gas causes it to rise into upper header tube 74 because the gas in the risers is now at a lower density than the helium gas in both down comer tube 44 and lower header tube 52 and is naturally driven upwards by the flow of higher density helium gas through convective cooling loop 13. To complete the cooling cycle, the warmer, lower density helium gas travels through upper header tube 74, across the downstream end of refrigerator 24, across heat station 30, and down into down comer tube 44 to start the cooling cycle again.

An important aspect of the invention relates to the size selection of the tubes forming the closed flow path for the flow of helium gas through convective cooling loop 13. That is, a uniform flow path is constructed to insure an equal mass flow rate of helium gas through each portion of convective cooling loop 13. That is, an equal mass of pressurized helium gas flows through a first portion of convective cooling loop 13 including down comer tube 44 and lower header tube 52 where the helium gas is essentially at a constant temperature equal to that of refrigerator 24 and through a second portion of convective cooling loop 13 including riser tubes 68 and upper header tube 74 where the gas is at a relatively warmer temperature, as compared to the gas in the first portion. Conceptually, the size of the tubes can be changed to compensate for the required path length. For example, by selecting smaller tubes, there is a more restricted flow and less cooling. Conversely, with wider tubes, there is less restricted flow and more cooling.

In an exemplary system of the type illustrated in FIGS. 1 and 2, the helium gas flows freely down into down comer tube 44 having a 8.3 millimeter (mm) internal diameter (ID) and into lower header tube 52 having the same diameter. Note that lower header tube 52 is bent back on itself such that the length of each flow path is the same so that the flow through each riser tube is the same. Riser tubes have a 2.4 mm ID and upper header 74 also has an 8.3 mm ID in the present example.

An important aspect of the invention is that the coolant medium, preferably cold helium gas, inherently circulates through convective cooling loop 13 in hollow support housing 12 of system 10 by means of natural convection of the cold helium gas. Natural convection is advantageous because it results in the helium gas being circulated at a more uniform temperature through convective cooling loop 13 in a relatively lightweight, support housing 12. Also with natural convention, there is no need for additional components such as a pump which adds cost and weight to the overall cooling system.

To further increase the effective cooling of support housing 12, it is desirable for the helium gas in the convective cooling loop 13 to be at an elevated pressure of between about 1 MPa and about 3 MPa. This aspect of the invention can be understood as follows.

Referring to FIG. 2, helium gas circulates in convective cooling loop 13 through housing 12 because of the total pressure difference between upper header tube 74 and lower header tube 52. This total pressure difference is equal to the difference between the density of the helium gas in lower header tube 52 and the helium gas in upper header tube 74 times the height. Since the difference in densities between the helium gas in these two portions of convective cooling loop 13 increases almost linearly with pressure (based on helium gas being almost an ideal gas where the density is directly proportional to the pressure), at an elevated pressure the increased density of the helium gas leads to an increased pressure differential. The heat, which is transported by the mass flow, equals the mass flow rate times the specific heat of helium gas times the temperature change of the helium gas. That is, with a higher pressure, there is a higher rate of mass circulation. This leads to the change in temperature being approximately equal to one divided by the pressure difference. In effect, by increasing the pressure of the gas in convective cooling loop 13, there is a reduced temperature change. This is important because ideally, superconducting magnet 11 is kept at a uniform temperature of below about 15 K. while heat is being extracted. Therefore, the change in temperature is kept as small as possible with the heat extraction being as large as possible. Thus, the higher pressure leads to extracting the same amount of heat with a lower temperature differential.

In the present example, the helium gas in down comer tube 44 is at a temperature of 8 K. and at a pressure of 2 MPa. This results in a density of 126.2 grams per liter (g/L). The helium gas traveling through riser tubes 68 warms to a temperature of 8.3 K. and a reduced density of 121.65 g/L within upper header tube 74. Assuming a constant rate of warming in riser tubes 68, the pressure difference available to drive helium gas around the convective cooling loop is equal to the difference in density times the height divided by 2, a value of 17.2 Pa for this example. This is equal to the pressure drop in cooling loop 13. The division by two is because of the assumption of an average temperature change. The mass flow rate of 0.30 grams per second absorbs 0.4 W in warming from 8.0 K. to 8.3 K. The actual procedure for calculating the temperature rise, circulation rate, and pressure drop is an iterative one in which several values of temperature rise are assumed and the corresponding mass flow rate and driving pressure difference are calculated. The mass flow rate is then used to calculate the pressure drop. The iteration continues until the driving pressure difference equals the pressure drop.

Another advantage of increasing the pressure of the helium gas is the reduction of both the velocity of the gas flowing in the circulation loop and the pressure drop. These factors permit the use of smaller diameter tubes in cooling loop 13. Assuming the tubes to be aluminum in this example, they weigh about 0.2 kg. A similar conductive cooling shell operating under the principles of the prior art and constructed of high purity aluminum, would also have a 0.3 K. temperature difference but would weigh about 0.6 kg. Moreover, if that same cooling shell were made of the more common 6063 grade of aluminum, it would weigh about 25 kg.

The convective cooling loop 13 of the present invention has two other distinct advantages associated with the effect of a power interruption on the magnet 11, when compared with prior art conductive cooling systems. Assuming that superconducting magnet 11 is allowed to warm from 8 K. to 10 K. before it goes normal, then it can continue to operate for 3.5 seconds after cooling is stopped if the conductive shell is 0.6 kg of A1. The time of operation after cooling has stopped increases to 144 seconds if the aluminum shell weighs 25 kg. When power is interrupted, the refrigerator 24 starts to warm up and the conductive losses that are internal to expander 26 causes heat to flow toward the cold downstream end of refrigerator 24. As a result, cold heat station 30 initially warms up when refrigerator 24 is restarted, and then cools back to its normal operating temperature.

A second advantage which the convectively cooled loop 13 provides is that the heat generated by restarting refrigerator 24 is not transferred to superconducting magnet 11 because convective loop 13 acts as a thermal switch and only transfers heat upward toward the upper header 74 and not downward toward lower header 52. That is, since the warmer helium gas near refrigerator 24 has a lower density than the colder helium gas which is in down comer tube 44 and lower header tube 52, there is no pressure difference available to drive the warm helium gas towards the colder part of the cooler loop 13, i.e., down into down comer tube 44 and lower header tube 52. This thermal disconnect which is an inherent part of system 10 is important because it insures that the hot and cold gases do not mix and thereby reduce the amount of circulation through coolant loop 13.

Figure 3:
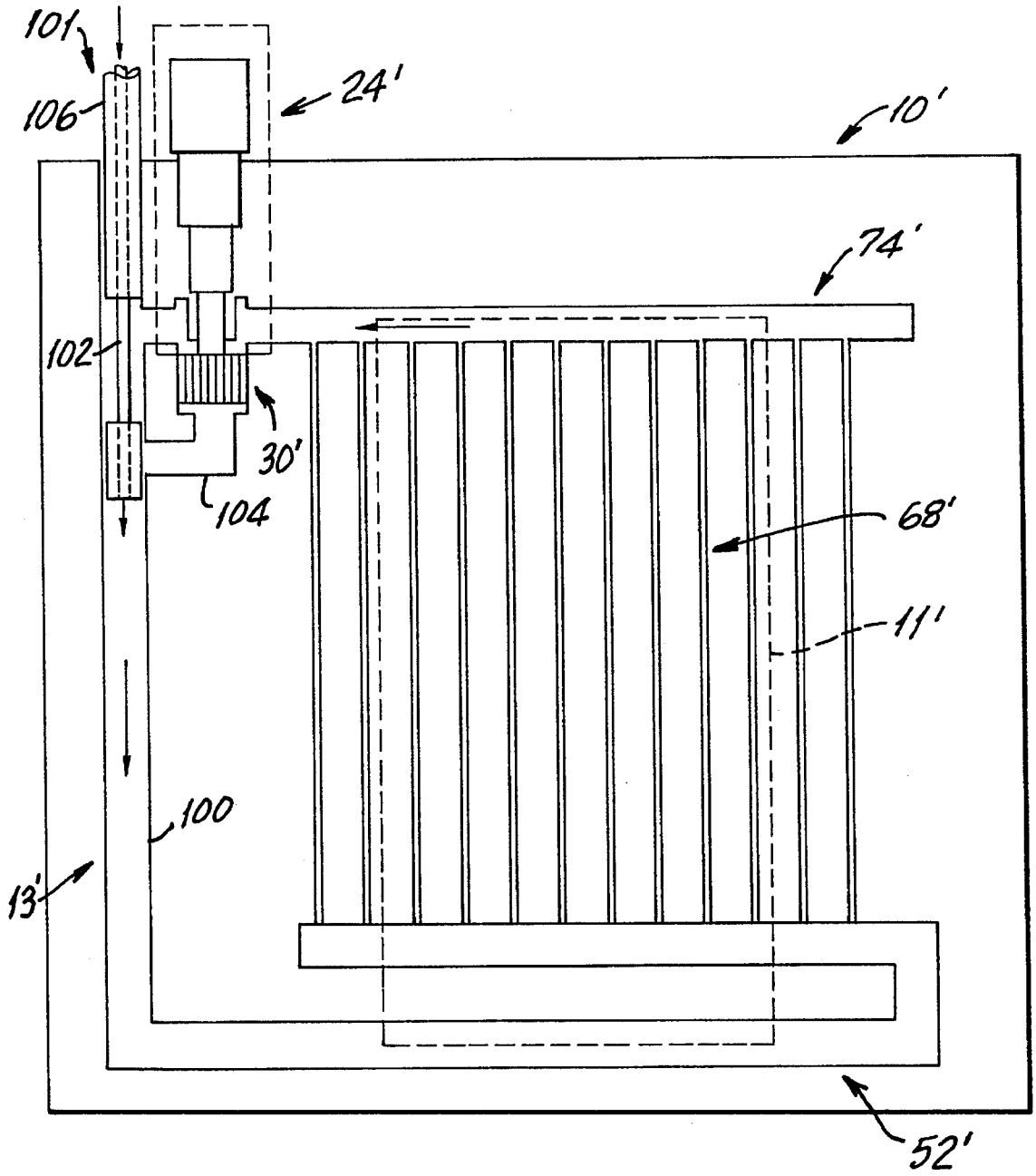
FIG. 3 is a schematic side view of a second embodiment of a superconducting magnet structure with a convective cooling loop and additional structure for initial startup cooling of the magnet.

While the above described apparatus and method of the invention provides a very effective means of convectively cooling a superconducting magnet 11, it is also within the terms of the invention to provide an alternative embodiment, as illustrated in FIG. 3, wherein system 10 has a first mode of operation to quickly bring superconducting magnet 11 to its operating temperature and a second mode of operation to maintain magnet 11 at an optimum operating temperature. Referring to FIG. 3, there is shown a schematic of a lightweight, convective cooling loop 13' and system 10', in accordance with the second embodiment, which has a first mode of operation to quickly and effectively bring magnet 11' down to its operating temperature and a second mode to maintain magnet 11 at an optimum operating temperature. Throughout the specification, primed, double primed and triple primed reference numerals represent structural elements which are substantially identical to structural elements represented by the same unprimed reference numerals. The present invention accomplishes these two modes of cooling superconducting magnet 11' in system 10' with a unique structure and method by which liquid cryogens, such a liquid nitrogen at a temperature of about 80 K. and then liquid helium at 4.2 K., are initially introduced into down comer tube 100 through a by-pass header 101 which includes an inlet tube 102. The liquid cryogens flow through the convective cooling loop 13' including down comer tube 100, a lower header tube 52', riser tubes 68, upper header tube 74', into closed cycle refrigerator 24', through cold heat station 30', into a connector tube 104 having its downstream end connected to down comer tube 100. As the liquid cryogens vaporize and circulate through convective cooling loop 13, the warmer, returning gas which now has a lower density, cannot mix with the entering higher density, fluid and therefore is forced to flow upward and out of an exhaust tube 106 of by-pass header 101 which can be concentrically positioned about inlet tube 102.

After the liquid helium lowers the temperature of magnet 11' down to within its operating range of less than 15 K., the flow of liquid helium is turned off. A second high pressure, helium gas is then introduced into convective cooling loop 13' through tube 106, the refrigerator is turned on and the system operates in accordance with the principles previously discussed with regard to the first embodiment, as illustrated in FIGS. 1 and 2.

Figure 4:
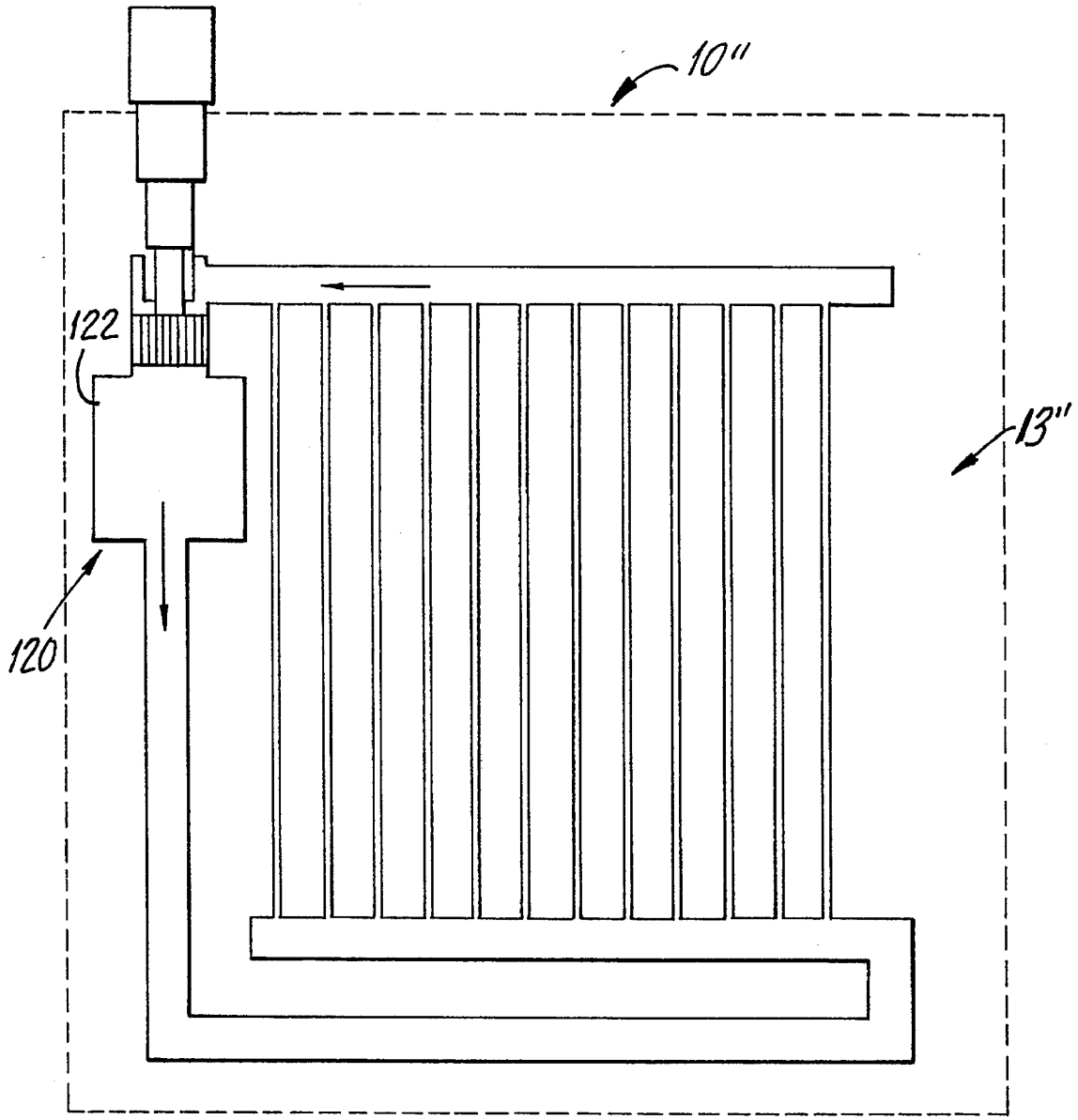
FIG. 4 is a schematic side view of a third embodiment of a superconducting magnet structure with a convective cooling loop and additional cold storage structure provided in the convective cooling loop.

While the above described apparatus and method of the invention provides a very effective means of convectively cooling superconducting magnets 11 and 11', it is also within the terms of the invention to provide an alternative embodiment, as illustrated in FIG. 4, wherein there is shown a schematic side view of a third embodiment of a superconducting magnet structure 10" with a convective cooling loop 13" and additional cold storage structure 120 provided in the convective cooling loop 13" to maintain the cold temperature in loop 13" for a longer period of time in the event the cooling system malfunctions. The cold storage structure 120 can simply be provided by increasing the size of a section of 122 of the down comer tube 44".

Figure 5:
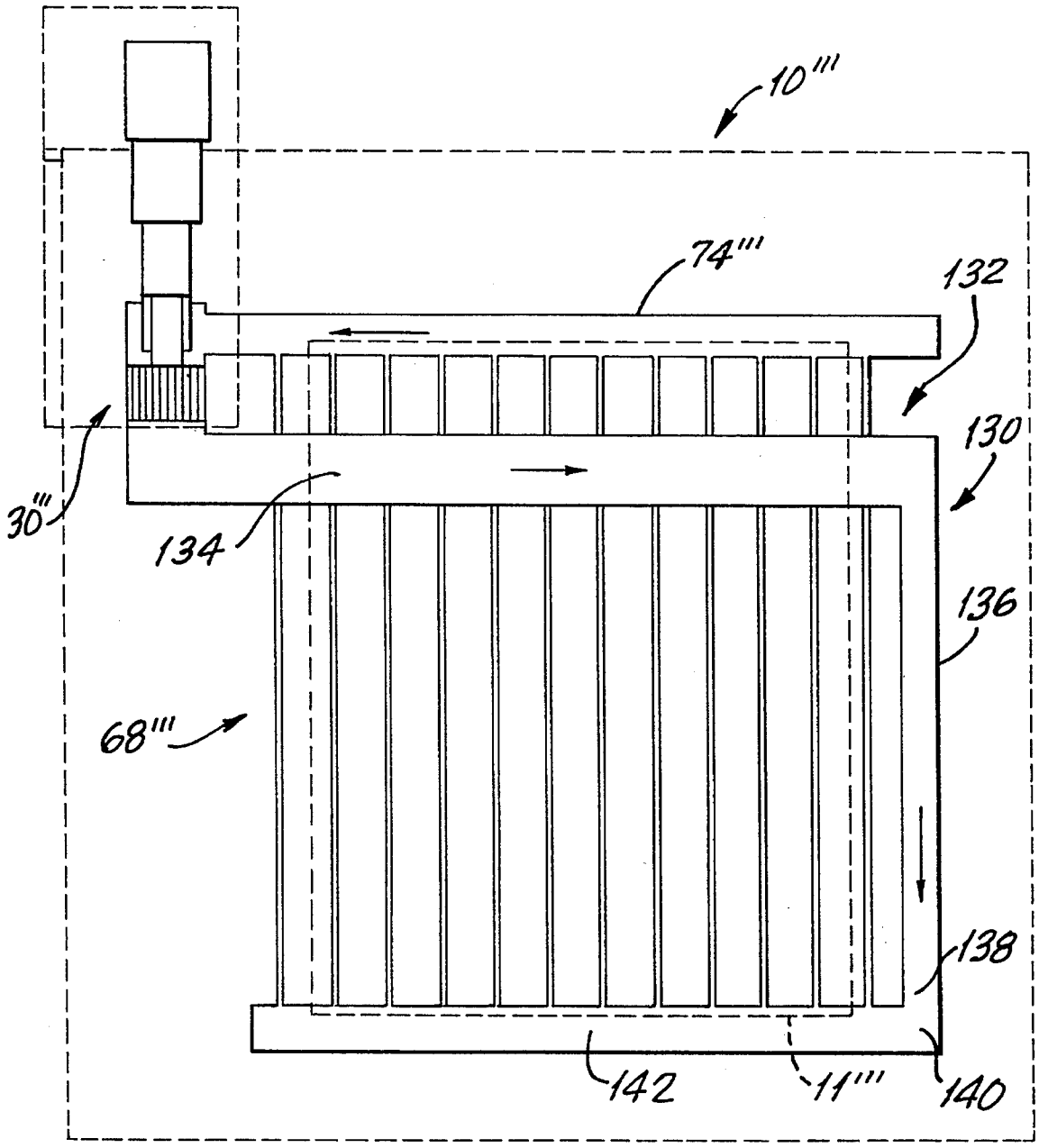
FIG. 5 is a schematic side view of a fourth embodiment of a superconducting magnet structure with a convective cooling loop and a cold gas accumulator.
Figure 6:
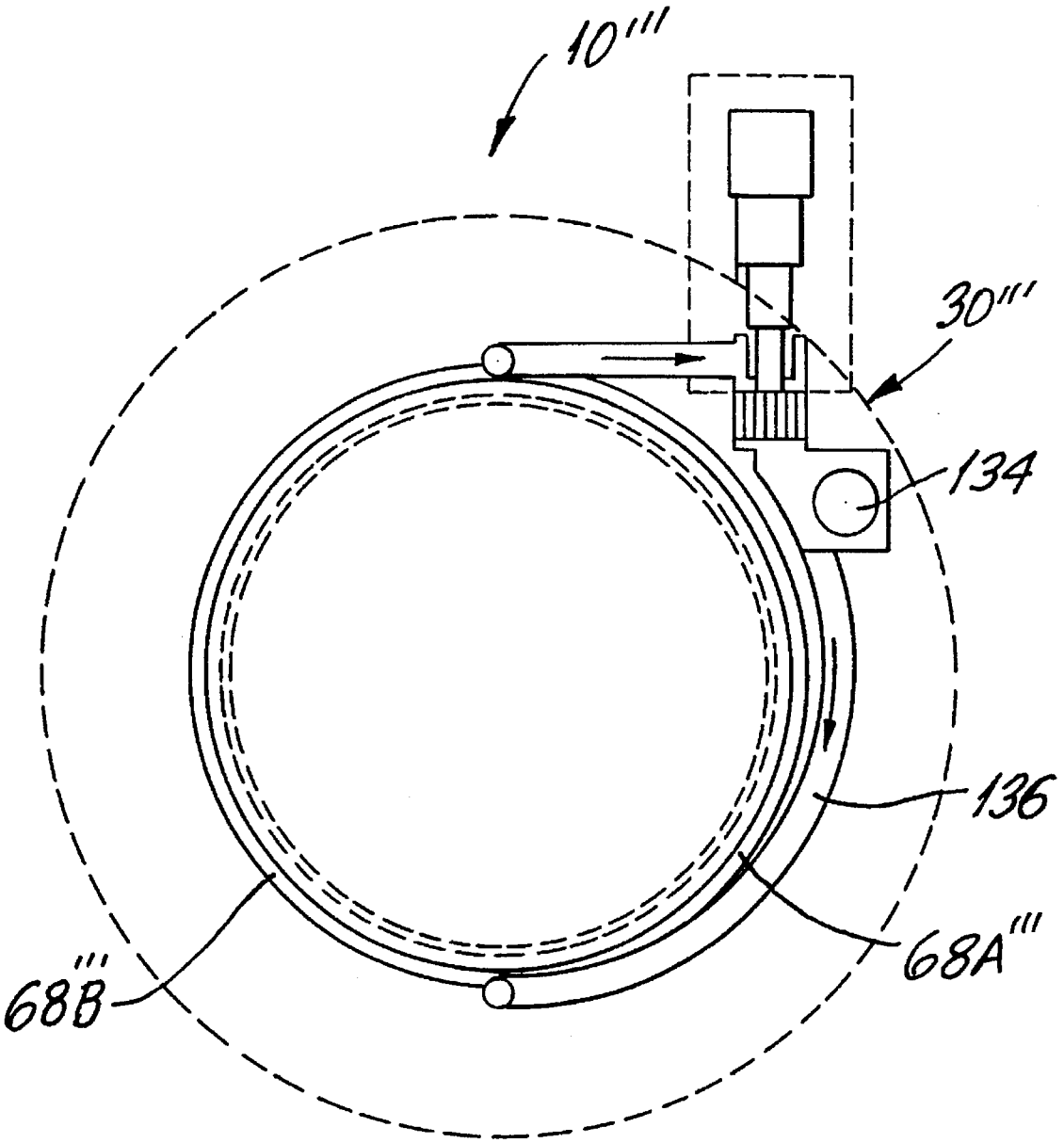
FIG. 6 is a schematic end view of the fourth embodiment in accordance with the invention.

While the above described apparatus and method of the invention provides a very effective means of providing additional cooling for a superconducting magnet 11", it is also within the terms of the invention to provide an alternative embodiment, as illustrated in FIGS. 5 and 6, wherein a fourth embodiment of a superconducting magnet structure 10'" with a convective cooling loop 130 provides still more additional cooling as compared with the embodiment of FIGS. 4 and 5. The down comer tube 132 is now positioned below and includes a horizontal section 134 below upper header tube 74'". At the end of the horizontal section 134, a vertical section 136 extends downward away from cold heat station 30''' to a location below magnet 11'''. Further, the vertical section 136 of down comer tube 130 has a radius of curvature, as shown in FIG. 6, which is substantially the same as that of magnet 11'''. The lower end 138 of down comer tube 44 is connected to an inlet 140 of a lower header tube 142 which in turn is adjacent the bottom of magnet 11'''. Convective cooling loop 13 further includes a plurality of spaced, cylindrically shaped, riser tubes 68''' which surround and are in close thermal contact with magnet 11'''. As shown in FIGS. 5 and 6, each of the riser tubes 68''' has a curved section 68A''' and 68B''' which are connected at their lower ends to lower header tube 142 and project upward so that their upper end is connected to upper header tube 74'''. The advantage of the fourth embodiment, is that in the case of a power outage, an inventory of cold gas remains in the horizontal section 134 of down comer tube 132.

Figure 7:
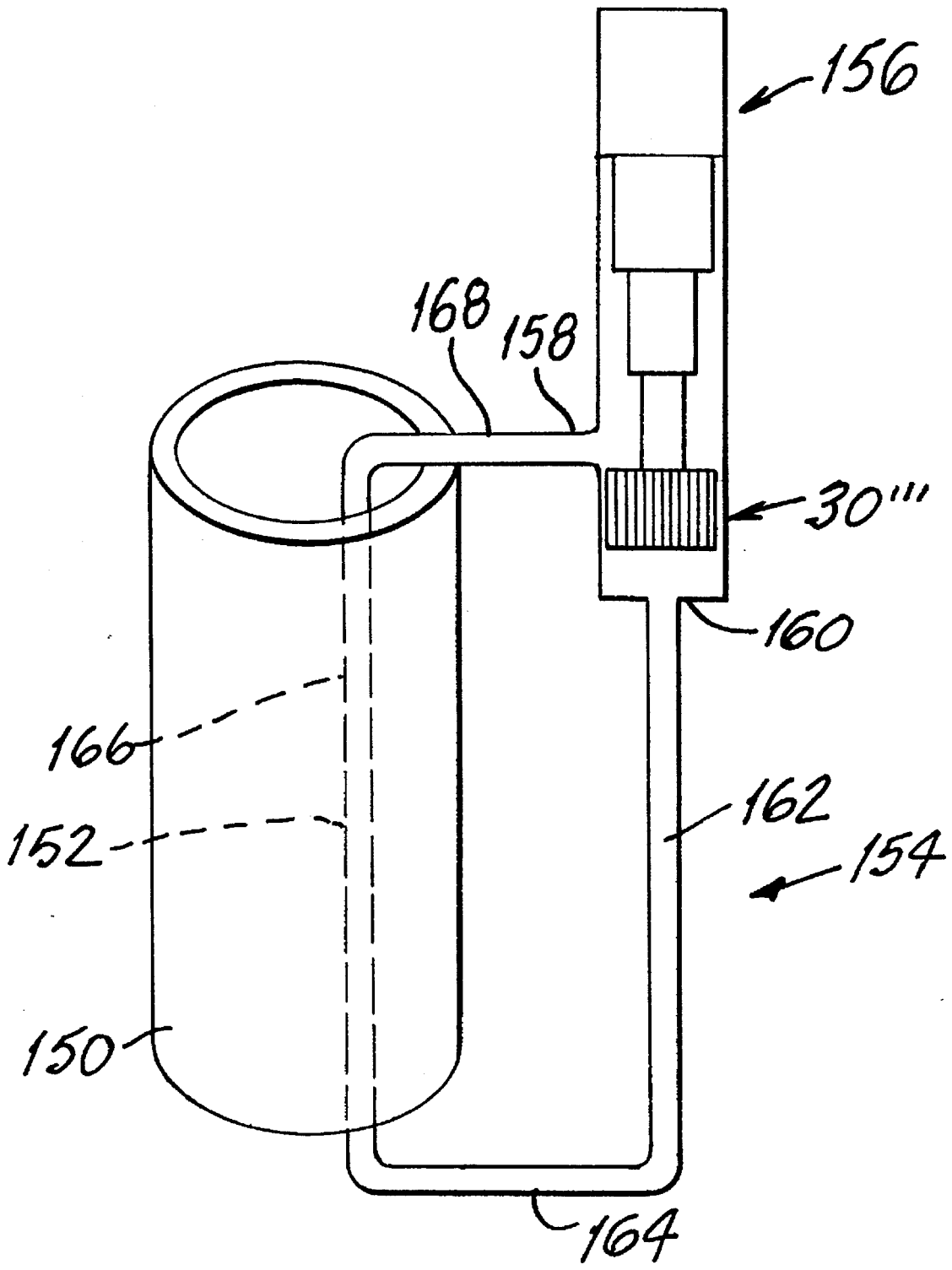
FIG. 7 is a schematic side view of a fifth embodiment of the present invention wherein a superconducting magnet is oriented vertically and cooled by a single riser tube of a convective cooling loop.

While the above described apparatus and method of the invention provides a very effective means of convectively cooling a superconducting magnet 11, it is also within the terms of the invention to provide an alternative embodiment, as illustrated in FIG. 7, wherein a fifth embodiment of the present invention provides superconducting magnet 150, which is substantially the same as magnet 11 and oriented vertically. Magnet 150 is cooled by a single riser tube 152 of a convective cooling loop 154. Cooling loop 154 includes a conventional, closed cycle refrigerator 156, substantially identical to closed cycle refrigerator 24, that is positioned adjacent to magnet 150. The downstream end of refrigerator 156 has a cold heat station 30''' having inlet and outlet sections 158 and 160, respectively.

The outlet section 160 of cold heat station 30 is connected to an upper end of a down comer tube 162 of convective cooling loop 154. Down comer tube 162 is positioned in spaced relationship to one side of magnet 150 and extends downward from cold heat station 30 to a location below magnet 150. The lower end of down comer tube 162 is connected to a lower header tube 164, a section of convective cooling loop 154, which extends horizontally outward from down comer tube 162 and below the bottom of magnet 150. Lower header tube 164 is connected to a riser tube 152 which extends vertically upward and is in close thermal contact with magnet 150. An upper header 168 connects the upper end of tube 166 to the inlet section 158 of cold heat station 30'''.

In operation, the heat generated by magnet 150 flows radially outward through a light aluminum shell disposed about the magnet 150. Since the magnet is oriented vertically, it can be cooled by a single riser tube 152.

It is apparent that there has been provided in accordance with this invention apparatus and methods for cooling a superconducting magnet by circulating a pressurized helium gas through a cooling loop by natural convection that satisfy the objects, means and advantages set forth hereinbefore. In addition, apparatus and methods have been provided for quickly and effectively cooling the superconducting magnet down to operating temperature and to maintain the low operating temperature after malfunction of the system.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

We claim:

1. A system for cooling a superconducting magnet maintained at a substantially uniform temperature, comprising:

means for convectively cooling said superconducting magnet with a flow of helium gas, said means for convectively cooling including (a) gas-containing cooling loop means, at least a portion of said cooling loop means being in heat transfer relationship with said superconducting magnet, said helium gas circulating in said cooling loop means by natural convection to remove heat from said superconducting magnet and (b) refrigeration means for removing heat from said helium gas.

2. The system of claim 1 wherein said helium gas is at a pressure of about 1 MPa to about 3 MA.

3. The system of claim 2 wherein said superconducting magnet is at a substantially uniform temperature of less than about 15 K.

4. The system of claim 1 further including a by-pass header to direct a liquid cryogen into said cooling loop means for initially removing heat from said superconducting magnet to lower the temperature of said superconducting magnet to its operating temperature.

5. A system for cooling a superconducting magnet maintained at a substantially uniform temperature, comprising:

refrigerator means for cooling helium gas;

a down comer tube connected to said refrigerator means for guiding said cooled helium gas therethrough to a lower header tube located below said superconducting magnet;

at least one riser tube connected at a lower end thereof to said lower header tube and at an upper end thereof to an upper header tube located above said superconducting magnet, said at least one riser tube being in heat transfer relationship with said superconducting magnet to absorb heat from said magnet and to warm said helium gas, a temperature differential being created by said warming in said helium gas in said at least one riser tube, said gas being warmer at said upper end than at said lower end, said temperature differential inducing an upward naturally convective flow of helium gas in said at least one riser tube toward said upper header tube; and said upper header tube guiding said warmed helium gas, through said refrigeration means to cool said warmed helium gas.

6. The system of claim 5 wherein said refrigeration means includes a refrigerator and a cold heat station, said cold heat station having an upper end abutted against said refrigerator and connected to said upper header tube and a lower end connected with said down comer tube, said cold heat station including a plurality of flow channels for cooling said helium gas flowing from said upper header tube, through said flow channels, and into said down comer tube.

7. The system of claim 6 wherein said refrigerator is a Gifford-McMahon or Stirling type refrigerator.

8. The system of claim 5 wherein said cooling loop means is constructed of more than one tube which are sized so that the mass flow rate of said helium gas in said riser tubes is uniform.

9. The system of claim 5 wherein said riser tubes provide multiple, parallel paths for said helium gas to flow about said superconducting magnet.

10. The system of claim 5 wherein said superconducting magnet is oriented vertically, said down comer tube is disposed adjacent said magnet, and a single riser tube extends vertically through said superconducting magnet to maintain a substantially uniform temperature within said superconducting magnet.

11. The system of claim 5 wherein said cooling loop means includes cold storage means for maintaining a cold temperature in said cooling loop means in the event of a cooling system malfunction.

12. The system of claim 11 wherein said cold storage means includes an enlarged section in said down comer tube.

13. The system of claim 11 wherein said cooling loops means includes:

said down comer tube having a horizontal section below an upper header tube and a vertical section extending downward from said horizontal section and said cold heat station to a lower header tube located below said magnet; and a plurality of spaced riser tubes connected at lower ends to said lower header tube and upper ends connected to said upper header tube whereby in the case of a power failure an inventory of cold gas remains in the horizontal section of said down comer tube.

14. The system of claim 5, wherein said at least one riser tube is dimensioned to cause a flow pressure drop in said rising flow of warmed helium gas that equals a pressure differential produced in said helium gas by said temperature differential, and concurrently to transfer a predetermined quantity of heat from said superconducting magnet to said helium gas.

15. A method of cooling a superconducting magnet maintained at a substantially uniform temperature, comprising the steps:

(a) providing at least one riser tube having an upper end and a lower end, said at least one riser tube being in heat exchange relationship with said superconducting magnet;

(b) connecting said at least one riser tube upper end to a cold station inlet and connecting said lower end to an outlet of said cold station to form a cooling loop including said at least one riser tube and said cold station;

(c) filling said cooling loop with helium gas, said helium gas in said at least one riser tube absorbing heat from said superconducting magnet via said heat exchange relationship, becoming warmer, expanding and rising by natural convection in said at least one riser tube, said warmed helium gas leaving said at least one riser tube at said upper end and flowing to said cold station where said helium gas is cooled and then returns from said cold station to said lower end of said at least one riser tube.

16. The method of claim 15 further including the step of providing said helium gas at an elevated pressure of about 1 MPa to about 3 MPa.

17. The method of claim 16 further including the step of maintaining said superconducting magnet at an operating temperature of less than about 15 K.

18. The method of claim 17 further including the step of thermally isolating said cooling loop between said cold station outlet and said riser tube lower end so that said helium gas entering said riser tube is at essentially the same temperature as said refrigerator cold station.

19. A method as in claim 15, wherein in step (a), said at least one riser tube is dimensioned to cause a flow pressure drop in said rising flow of warmed helium gas equal to a pressure differential produced in said helium gas by a temperature differential between said cooled helium gas at said lower end and said warmed helium gas at said upper end of said riser tube, said at least one riser tube being dimensioned to concurrently transfer a predetermined quantity of heat from said superconducting magnet to said helium gas.

20. A method as in claim 15, further comprising a step preceding step (c):

filling said cooling loop with a liquid refrigerant for initially removing heat from said superconducting magnet to lower the temperature of said superconducting magnet to its operating temperature, and then removing said liquid refrigerant from said cooling loop.

21. A method for cooling a superconducting magnet, comprising the steps of:

lowering the temperature of said superconducting magnet to its operating temperature of less than 15 K. during a first mode of operation, said first mode of operation including the step of circulating a liquid cryogen through a naturally convective cooling loop to remove heat from said superconducting magnet until the temperature of said magnet is lowered to its operating temperature;

stopping the circulation of said liquid cyrogen, removing said liquid cryogen and circulating helium gas having a temperature of less than about 15 K. through said natural convective cooling loop to maintain said superconducting magnet at a substantially uniform operating temperature.

22. The method of claim 21 further including the step of providing said helium gas at a pressure of about 1 MPa to about 3 MPa.

23. The method of claim 21 wherein said liquid cryogen is liquid helium.

24. A system for cooling a device maintained at a substantially uniform cryogenic temperature, comprising:

means for convectively cooling said device with a flow of cryogenic gas, said means for convectively cooling including (a) gas-containing cooling loop means, at least a portion of said cooling loop means being in heat transfer relationship with said device, said cryogenic gas circulating in said cooling loop means by natural convection to remove heat from said device and (b) refrigeration means for removing heat from said cryogenic gas.

25. The system of claim 24 wherein said cryogenic gas is helium gas at a pressure of about 1 MPa to about 3 MA.

26. The system of claim 25 wherein said device is at a substantially uniform temperature of less than about 15 K.

27. A system for cooling a device maintained at a substantially uniform cryogenic temperature, comprising:

refrigerator means for cooling a cryogenic gas;

a down comer tube connected to said refrigerator means for guiding said cooled cryogenic gas therethrough to a lower header tube located below said device;

at least one riser tube connected at a lower end thereof to said lower header tube and at an upper end thereof to an upper header tube located above said device, said at least one riser tube being in heat transfer relationship with said device to absorb heat from said device and to warm said cryogenic gas, a temperature differential being created by said warming in said cryogenic gas in said at least one riser tube, said gas being warmer at said upper end than at said lower end, said temperature differential inducing an upward naturally convective flow of cryogenic gas in said at least one riser tube toward said upper header tube; and said upper header tube guiding said warmed cryogenic gas through said refrigeration means to cool said warmed cryogenic gas.

28. The system of claim 27 wherein said refrigeration means includes a refrigerator and a cold heat station, said cold heat station having an upper end abutted against said refrigerator and connected with said down comer tube, said cold heat station including a plurality of flow channels for cooling said cryogenic gas flowing from said upper header tube, through said flow channels, and into said down comer tube.

29. The system of claim 27 wherein said cooling loop means includes cold storage means for maintaining a cold temperature in said cooling loop means in the event of a cooling system malfunction, said cooling loop means including:

said down comer tube having a horizontal section below an upper header tube and a vertical section extending downward from said horizontal section and said cold heat station to a lower header tube located below said device; and a plurality of spaced riser tubes connected at said lower ends to said lower header tube and said upper ends connected to said upper header tube whereby in the case of a power failure an inventory of cold gas remains in the horizontal section of said down comer tube.

30. A method of cooling a device maintained at a substantially uniform cryogenic temperature, comprising the steps:

(a) providing at least one riser tube having an upper end and a lower end, said at least one riser tube being in heat exchange relationship with said device;

(b) connecting said at least one riser tube upper end to a cold station inlet and connecting said lower end to an outlet of said cold station to form a cooling loop including said at least one riser tube and said cold station;

(c) filling said cooling loop with cryogenic gas, said cryogenic gas in said at least one riser tube absorbing heat from said device via said heat exchange relationship, becoming warmer, expanding and rising by natural convection in said at least one riser tube, said warmed cryogenic gas leaving said at least one riser tube at said upper end and flowing to said cold station where said cryogenic gas is cooled and then returns from said cold station to said lower end of said at least one riser tube.

31. A method as in claim 30, wherein in step (a), said at least one riser tube is dimensioned to cause a flow pressure drop in said rising flow of warmed cryogenic gas equal to a pressure differential produced in said cryogenic gas by a temperature differential between said cooled cryogenic gas at said lower end and said warmed cryogenic gas at said upper end of said riser tube, said at least one riser tube being dimensioned to concurrently transfer a predetermined quantity of heat from said device to said cryogenic gas.

32. The method of claim 30 further including the step of providing helium gas at an elevated pressure of about 1 MPa to about 3 MPa as said cryogenic gas.

33. The method of claim 32 further including the step of maintaining said device at an operating temperature of less than about 15 K.

34. The method of claim 30 further including the step of thermally isolating said cooling loop between said cold station outlet and said riser tube lower end so that said cryogenic gas entering said riser tube is at essentially the same temperature as said refrigerator cold station.

* * * * *